US007416438B2

(12) United States Patent
Hashiguchi et al.

(10) Patent No.: US 7,416,438 B2
(45) Date of Patent: Aug. 26, 2008

(54) CONNECTOR

(75) Inventors: Osamu Hashiguchi, Tokyo (JP); Kanji Inoue, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/893,741

(22) Filed: Aug. 16, 2007

(65) Prior Publication Data

US 2008/0050966 A1 Feb. 28, 2008

(30) Foreign Application Priority Data

Aug. 23, 2006 (JP) ..... 2006-226755

(51) Int. Cl.
*H01R 12/24* (2006.01)

(52) U.S. Cl. ..... 439/495; 439/260

(58) Field of Classification Search ..... 439/495, 439/260

See application file for complete search history.

(56) References Cited

U.S. PATENT DOCUMENTS 6,855,002 B2 * 2/2005 Chiu ..... 439/495
7,044,773 B2 * 5/2006 Suzuki et al. ..... 439/495
7,094,093 B2 * 8/2006 Nakano et al. ..... 439/495
7,147,498 B1 * 12/2006 Gillespie et al. ..... 439/260
7,172,446 B1 * 2/2007 Hashimoto et al. ..... 439/260
7,223,110 B2 * 5/2007 Suzuki et al. ..... 439/260
7,258,561 B2 * 8/2007 Fukazawa ..... 439/260
7,311,542 B2 * 12/2007 Suzuki ..... 439/260

FOREIGN PATENT DOCUMENTS

JP 2004-221067 A 8/2004

* cited by examiner

*Primary Examiner*—Michael C Zarroli
(74) *Attorney, Agent, or Firm*—Frishauf, Holtz, Goodman & Chick, P.C.

(57) ABSTRACT

A connector capable of facilitating the insertion of a connected object, and obtaining a sufficient contact force. Contacts are held by a housing including a receiving space into which is inserted FPC. An actuator is mounted in the housing in a manner pivotally movable between open position for inserting FPC into the space, and closed position for holding FPC therein. The contacts have respective seesaw-type beams having one ends thereof formed with portions for contact with FPC, and the other ends thereof formed with power point portions for receiving the turning force of the actuator. The actuator has pressing portions for pushing downward the power point portions when open, to thereby lift them to move the contact portions out of the space, and cam portions for pushing upward the same when closed, to thereby push them downward to cause the contact portions to enter the space.

2 Claims, 13 Drawing Sheets

CONNECTOR

BACKGROUND OF THE INVENTION

1. Field of the Invention

This invention relates to a connector, and more particularly to a connector suitable for electrically connecting between an FPC (Flexible Printed Circuit) and a printed circuit board.

2. Prior Art

Conventionally, there has been proposed a connector comprising a plurality of contacts, a housing that holds the contacts, and an actuator that is rotatably mounted on the housing and elastically deforms the contacts to thereby bring the contacts into contact with an FPC (see Japanese Laid-Open Patent Publication (Kokai) No. 2004-221067).

The contacts each include a seesaw-type beam that has one end thereof formed with a contact portion for contact with the FPC, and the other end thereof formed with a power point portion on which the turning force of the actuator acts.

When the actuator is pivotally moved from an FPC-inserting position to an FPC-connecting position, the power point portions of the contacts are pushed upward by the actuator, and the contact portions of the contacts are pushed downward such that they enter a receiving space in the housing, to be urged against the FPC. As a result, it is possible to obtain a contact force required for bringing the contacts into contact with the FPC.

However, in some connectors configured as above, when the actuator is in the FPC-inserting position, part of the contact portions of the contacts stand in a track along which the FPC is inserted. This has been a factor which causes an increase in the force required for inserting the FPC into the receiving space of the housing.

SUMMARY OF THE INVENTION

The present invention has been made in view of these circumstances, and an object thereof is to provide a connector which is capable of facilitating the insertion of a connected object, and obtaining a sufficient contact force.

To attain the above object, the present invention provides a connector comprising a housing that has a receiving space into which a connected object is inserted, a plurality of contacts that are held by the housing, and each include a seesaw-type beam having one end thereof formed with a contact portion for contact with the connected object, and the other end thereof formed with a power point portion, and an actuator mounted in the housing such that the actuator is pivotally movable between an open position for allowing insertion of the connected object into the receiving space and a closed position for holding the connected object in the receiving space, the actuator including urging portions for enabling a turning force of the actuator to act on the power point portions when the actuator is in the open position, to push downward the power point portions to thereby move the contact portions out of the receiving space, and cam portions for enabling the turning force of the actuator to act on the power point portions when the actuator is in the closed position, to push upward the power point portions to thereby move the contact portions into the receiving space.

With the arrangement of the connector according to the present invention, it is easy to insert the connected object into the receiving space, and after the connected object is inserted into the receiving space, a large contact force is generated between the contact portions of the contacts and the connected object.

Preferably, the housing includes seesaw-type locking sections each having one end thereof formed with a nail portion for engagement with the connected object, and the other end thereof formed with a locking power point portion on which the turning force of the actuator acts, and the actuator includes urging portions for the nail portions, for pushing downward the locking power point portions when the actuator is in the open position, to thereby move the nail portions away from the connected object, and cam portions for the nail portions, for pushing upward the locking power point portions when the actuator is in the closed position, to thereby move the nail portions toward the connected object.

With the arrangement of the preferred embodiment, it is possible to prevent the connected object from being easily removed from the connector.

The above and other objects, features and advantages of the present invention will become more apparent from the following detailed description taken in conjunction with the accompanying drawings.

DETAILED DESCRIPTION OF THE PREFERRED EMBODIMENT

The present invention will now be described in detail with reference to the drawings showing preferred embodiments thereof.

Referring to FIGS. 1 to 4, the connector is for an FPC (connected object), and is comprised of a housing 3, the first contacts 5, the second contacts 6, and the actuator 9.

Figure 1A:
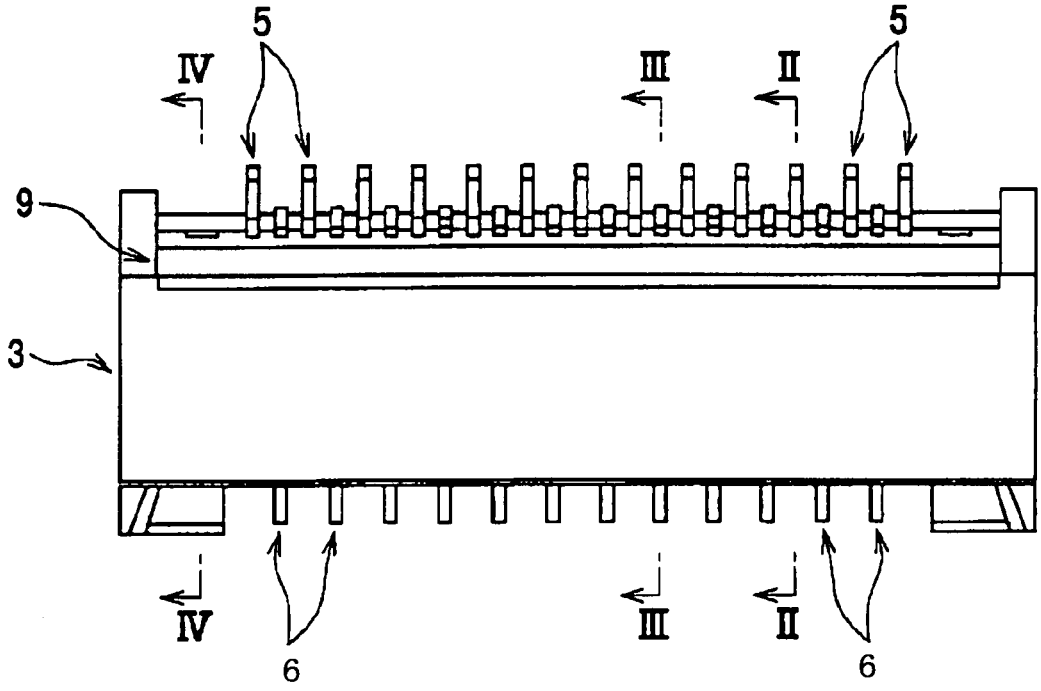
FIG. 1A is a plan view of a connector according to a first embodiment of the present invention.
Figure 1B:
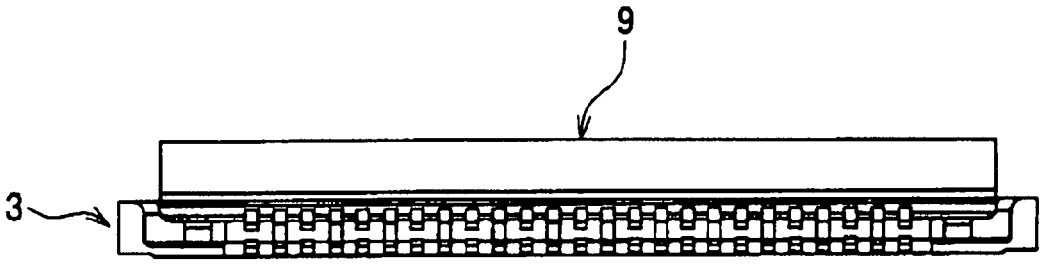
FIG. 1B is a front view of the connector.
Figure 1C:
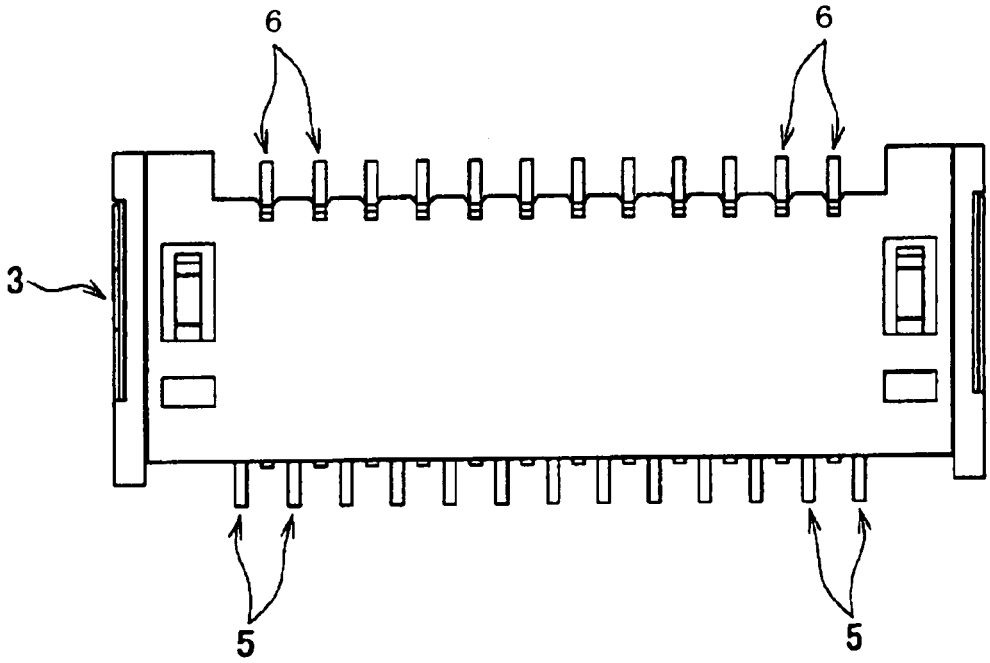
FIG. 1C is a bottom view of the connector.
Figure 1D:
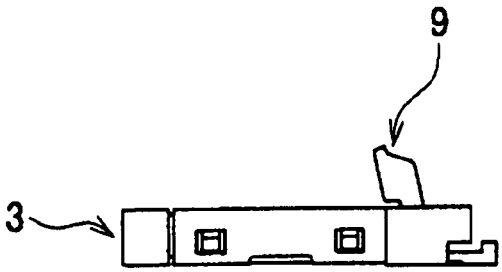
FIG. 1D is a side view of the connector.
Figure 2:
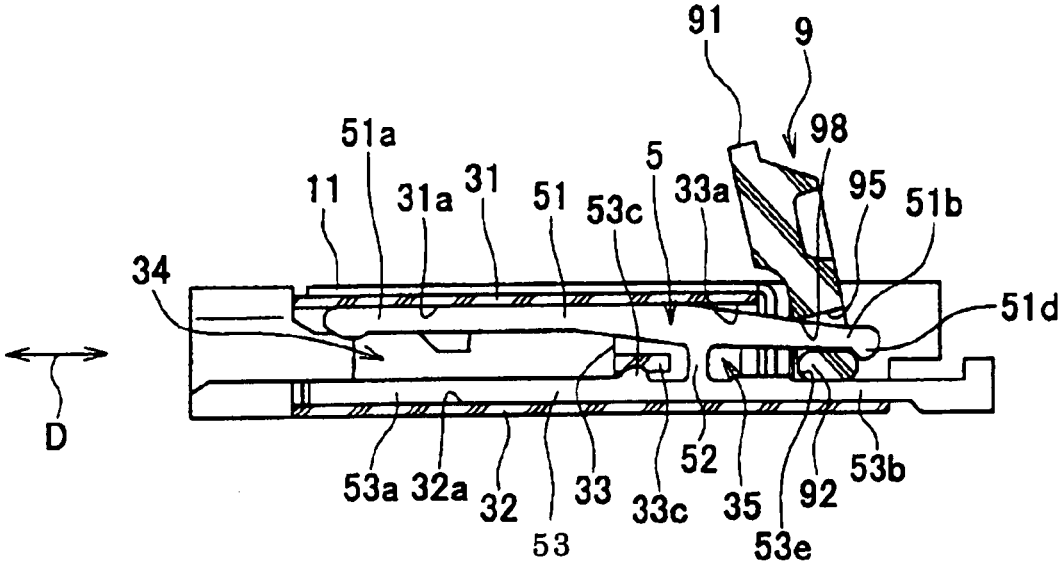
FIG. 2 is a cross-sectional view taken on line II-II of FIG. 1A.
Figure 3:
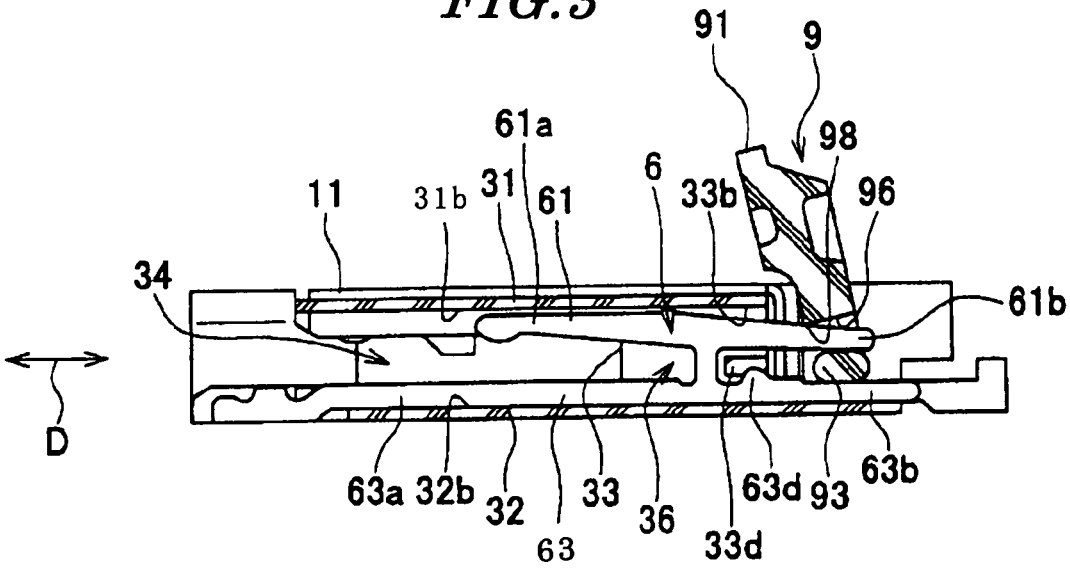
FIG. 3 is a cross-sectional view taken on line III-III of FIG. 1A.

As shown in FIGS. 2 and 3, the housing 3 includes a ceiling 31, a bottom 32, and a connecting portion 33. Formed between the ceiling 31 and the bottom 32 is an FPC-receiving space (receiving space) 34.

The ceiling 31 has accommodation grooves 31*a* and accommodation grooves 31*b* formed in a lower surface thereof such that they are arranged alternately in the longitudinal direction of the housing 3. An upper surface of the ceiling 31 is covered with a shield plate 11.

The bottom 32 has accommodation grooves 32*a* and accommodation grooves 32*b* formed in an upper surface thereof such that they are arranged alternately in the longitudinal direction of the housing 3.

The connecting portion 33 connects the ceiling 31 and the bottom 32. The connecting portion 33 has accommodation holes 33*a* and accommodation holes 33*b* formed therein such that they are arranged alternately in the longitudinal direction of the housing 3. Each accommodation hole 33*a* extends along the direction of insertion of the FPC, not shown, and communicates with associated ones of the accommodation grooves 31*a* and 32*a*. Each accommodation hole 33*b* extends along the direction of insertion of the FPC, and communicates with associated ones of the accommodation grooves 31*b*and 32*b*. The accommodation hole 33*a* has a press contact piece 33*c* formed therein. The accommodation hole 33*b* has a press contact piece 33*d* formed therein.

The above-described accommodation grooves 31*a* and 32*a* and accommodation holes 33*a* form a first contact-accommodating space 35. The above-described accommodation grooves 31*b* and 32*b* and accommodation holes 33*b* form a second contact-accommodating space 36.

Figure 4:
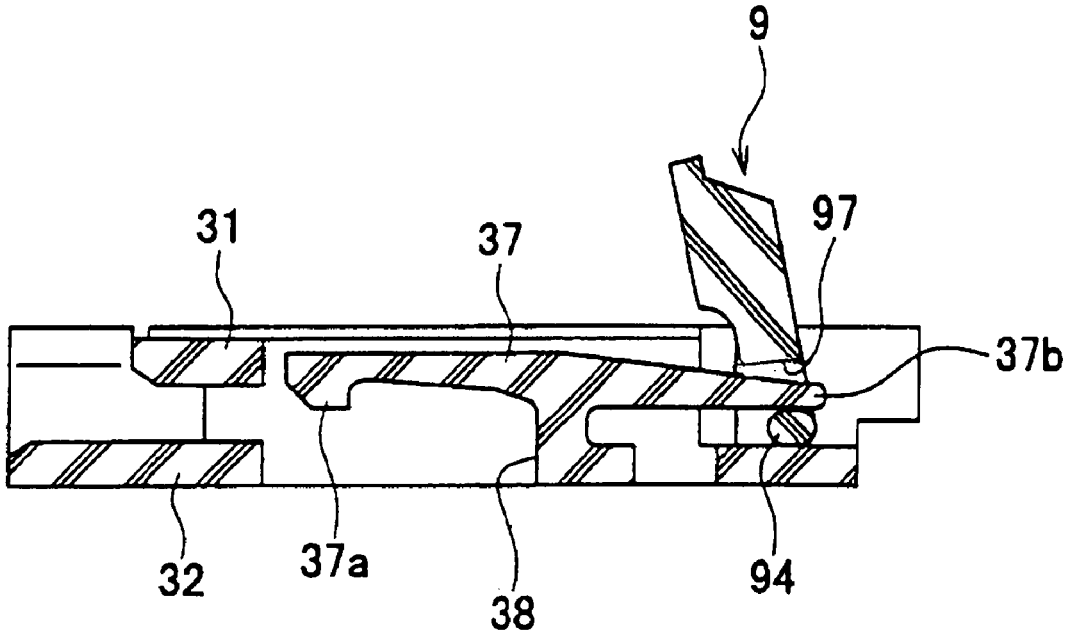
FIG. 4 is a cross-sectional view taken on line IV-IV of FIG. 1A.

As shown in FIG. 4, the ceiling 31 has opposite ends in the longitudinal direction thereof formed with seesaw-type lances (locking sections) 37. Each lance 37 has one end thereof formed with a nail portion 37*a*. The other end of the lance 37 is formed with a locking power point portion 37*b* for engagement with a third cam portion (cam portion for the nail portion) 94 of the actuator 9, referred to hereinafter. The lance 37 is fixed to the bottom 32 via a spring piece 38 such that it can perform a seesaw operation.

Figure 5:
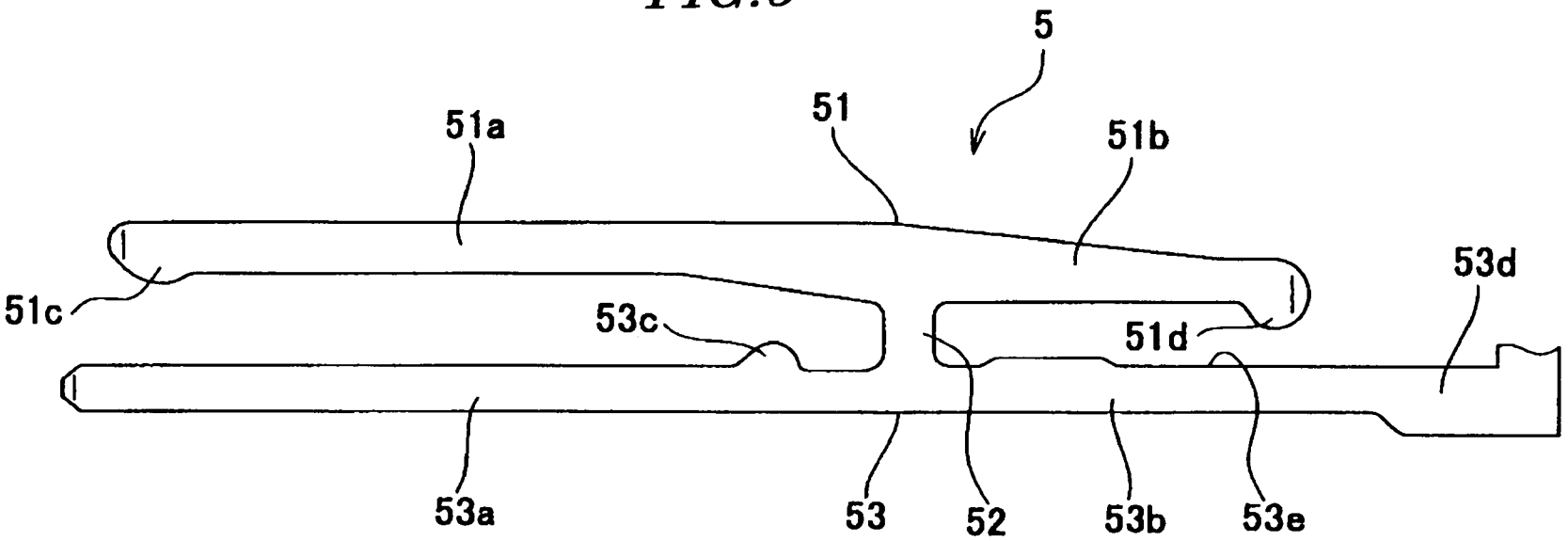
FIG. 5 is a side view of a first contact of the FIG. 1 connector.

Referring to FIG. 5, each first contact 5 includes a first beam 51, a spring piece 52, and a second beam 53. The first beam 51 is connected to the second beam 53 via the spring piece 52 such that it can perform a seesaw operation. The first beam 51 and the second beam 53 are substantially parallel to each other. The first beam 51 has a portion toward one end thereof (portion on the left side of the spring piece 52 as viewed in FIG. 5) formed as a contact portion 51*a*, and a portion toward the other end thereof (portion on the right side of the spring piece 52 as viewed in FIG. 5) formed as a power point portion 51*b*. The contact portion 51*a* is formed with a contact point 51*c*. The power point portion 51*b* has a rear end thereof formed with an engaging portion 51*d*.

The second beam 53 has a portion toward one end thereof (portion on the left side of the spring piece 52 as viewed in FIG. 5) formed as a first beam portion 53*a*, and a portion toward the other end thereof (portion on the right side of the spring piece 52 as viewed in FIG. 5) formed as a second beam portion 53*b*. The first beam portion 53*a* is formed with a press-fitted piece 53*c*. The press-fitted piece 53*c* is press-fitted into the press contact piece 33*c*, whereby the first contact 5 is held in a state fixed within the first contact-accommodating space 35. The second beam portion 53*b* is formed with a terminal portion 53*d*. The terminal portion 53*d* is soldered to a printed wiring board, not shown. Further, the second beam portion 53*b* is formed with a recess 53*e*.

Figure 6:
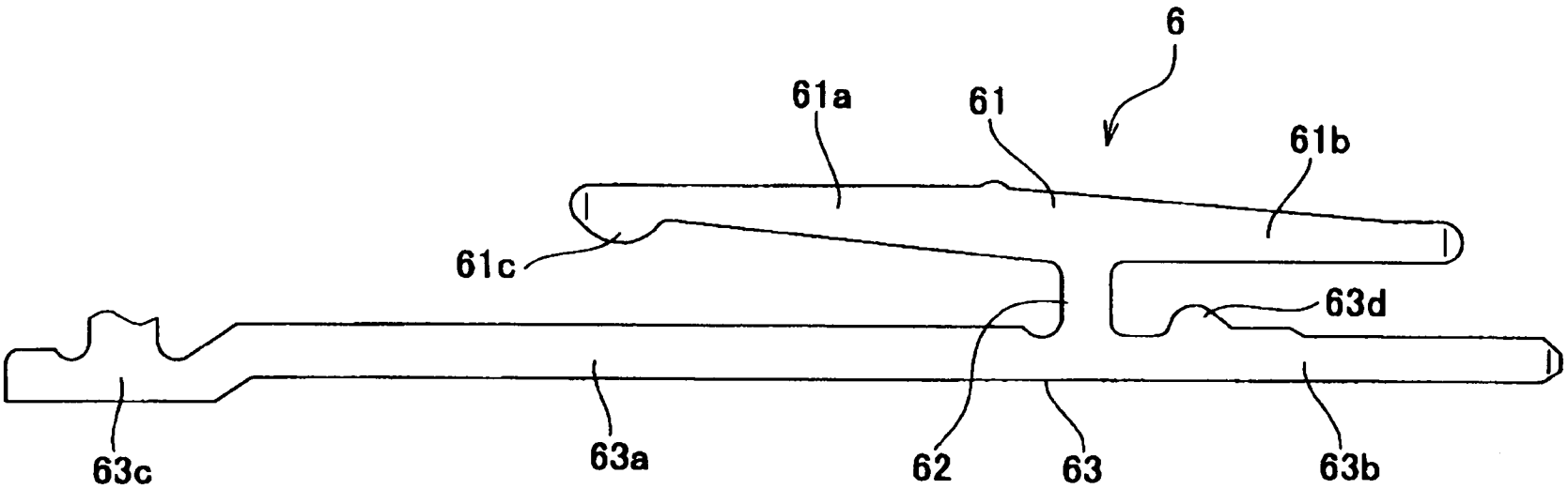
FIG. 6 is a side view of a second contact of the FIG. 1 connector.
Figure 7:
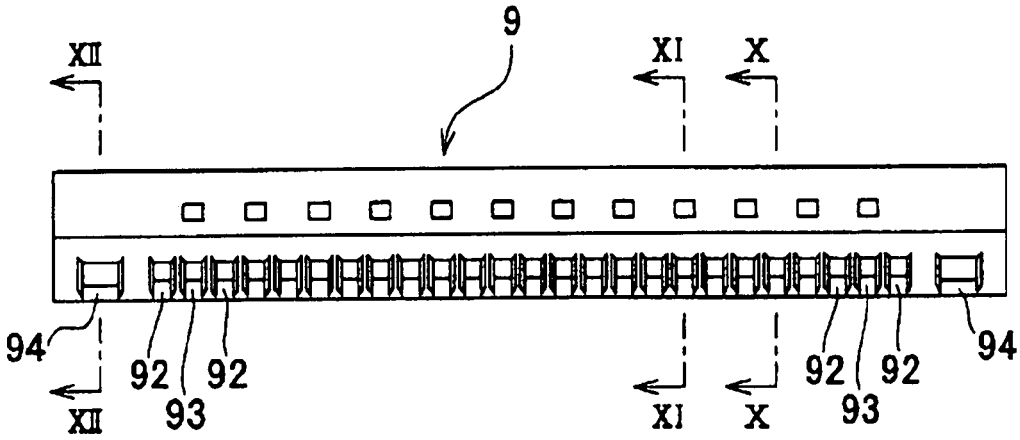
FIG. 7 is a plan view of an actuator of the FIG. 1 connector.
Figure 8:
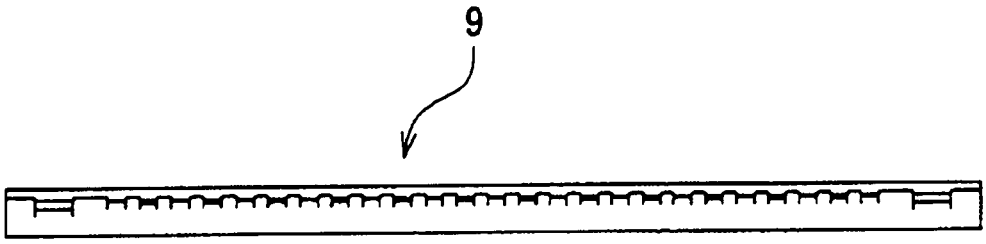
FIG. 8 is a front view of the actuator.
Figure 9:
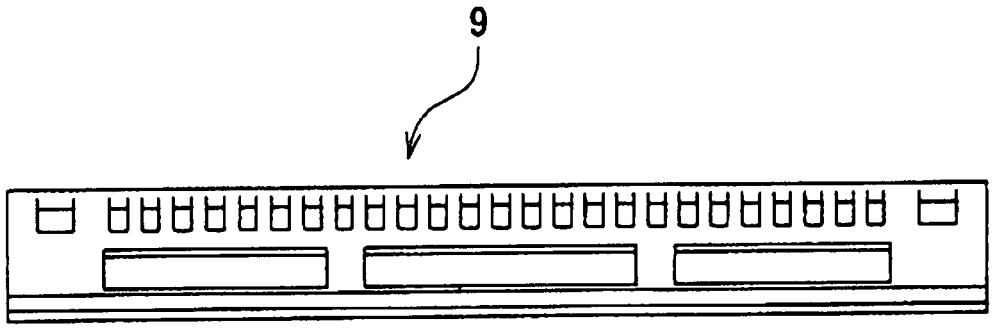
FIG. 9 is a bottom view of the actuator.
Figure 10:
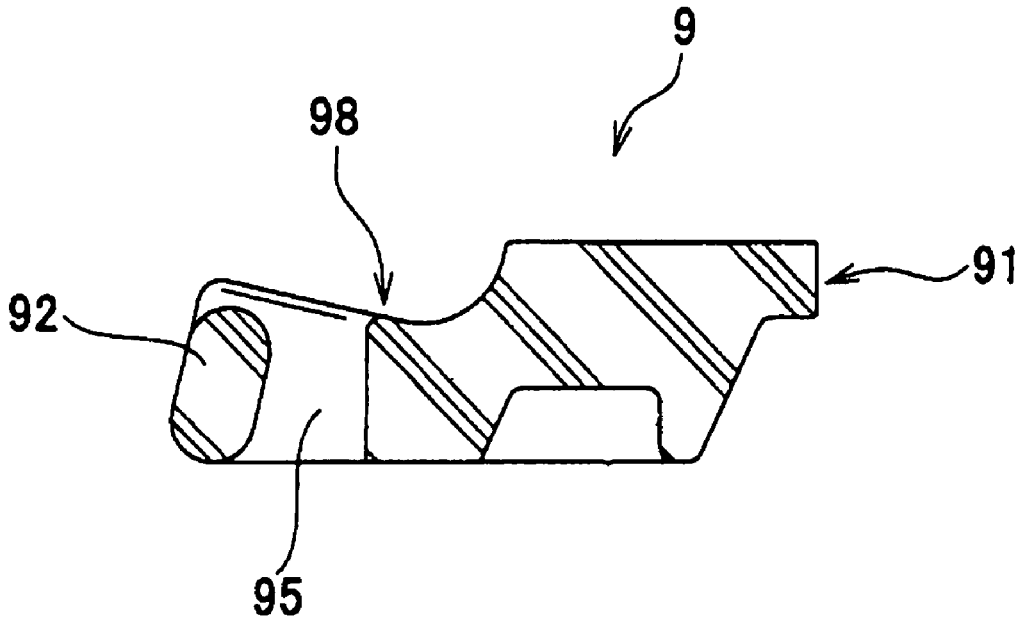
FIG. 10 is a cross-sectional view taken on line X-X of FIG. 7.
Figure 11:
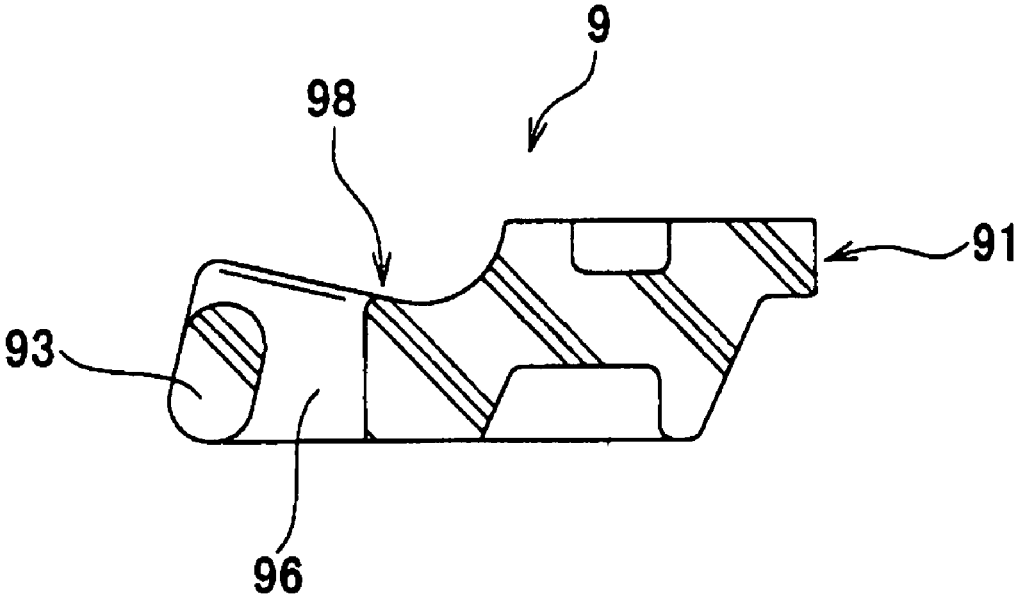
FIG. 11 is a cross-sectional view taken on line XI-XI of FIG. 7.
Figure 12:
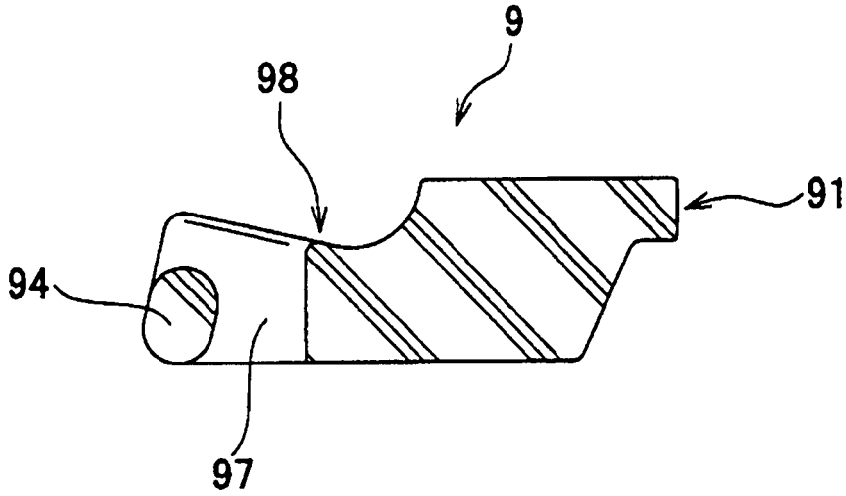
FIG. 12 is a cross-sectional view taken on line XII-XII of FIG. 7.

As shown in FIG. 6, each second contact 6 includes a first beam 61, a spring piece 62, and a second beam 63. The first beam 61 is connected to the second beam 63 via the spring piece 62 such that it can perform a seesaw operation. The first beam 61 is slightly inclined with respect to the second beam 63. The first beam 61 has a portion toward one end thereof (portion on the left side of the spring piece 62 as viewed in FIG. 6) formed as a contact portion 61*a*, and a portion toward the other end thereof (portion on the right side of the spring piece 62 as viewed in FIG. 6) formed as a power point portion 61*b*. The contact portion 61*a* is formed with a contact point 61*c*.

The second beam 63 has a portion toward one end thereof (portion on the left side of the spring piece 62 as viewed in FIG. 6) formed as a first beam portion 63*a*, and a portion toward the other end thereof (portion on the right side of the spring piece 62 as viewed in FIG. 6) formed as a second beam portion 63*b*. The first beam portion 63*a* has a foremost end thereof formed with a terminal portion 63*c*. The terminal portion 63*c* is soldered to the printed wiring board, not shown. The second beam portion 63*b* is formed with a press-fitted piece 63*d*. The press-fitted piece 63*d* is press-fitted into the press contact piece 33*d*, whereby the second contact 6 is held in a state fixed within the second contact-accommodating space 36.

As shown in FIGS. 7 to 12, the actuator 9 has one end in the direction of the width thereof formed with an operating section 91, and the other end in the direction of the width thereof formed with first cam portions 92, second cam portions 93, and third cam portions 94. The first cam portions 92, the second cam portions 93, and the third cam portions 94 each have a substantially elliptical shape in cross section. Although in the present embodiment, the sizes thereof are different from each other, they may have the same size.

The operating section 91 has a substantially convex shape. The actuator 9 is operated by putting a finger on the operating section 91.

The first cam portions 92 and the second cam portions 93 are in an alternate arrangement.

Each first cam portion 92 is sandwiched by the power point portion 51*b* and the second beam portion 53*b* of an associated one of the first contacts 5, and is further engaged with the engaging portion 51*d* and the recess 53*e* such that the first cam portion 92 is prevented from dropping off the associated first contact 5. Each second cam portion 93 is sandwiched by the power point portion 61*b* and the second beam portion 63*b* of an associated one of the second contacts 6. Therefore, the actuator 9 is pivotally held by the first contacts 5 such that it can be pivotally moved between an open position (position of the actuator 9 in a state where it can receive the FPC: the state shown in FIGS. 2 and 3) and a closed position (position of the actuator 9 in a state where the first and second contacts are brought into contact with the FPC: a state shown in FIG. 13A). Further, the first and second cam portions 92 and 93 each having a substantially elliptical shape in cross section are configured such that they are sandwiched by the power point portion 51*b* and the second beam portion 53*b* of the associated one of the first contacts 5, and the power point portion 61*b* and the second beam portion 63*b* of the associated one of the second contacts 6, respectively, and hence when the actuator 9 is in a position close to the open position, a moment for pivotally moving the actuator 9 toward the open position is generated, whereas when the actuator 9 is in a position close to the closed position, a moment for pivotally moving the actuator 9 toward the closed position is generated.

When the actuator 9 is in the closed position, the first cam portion 92 pushes upward the power point portion 51*b* of the associated first contact 5, whereby the contact portion 51*a* of the associated first contact 5 is pushed downward such that the contact portion 51*a* enters the FPC-receiving space 34.

The actuator 9 has through holes 95 formed therethrough at respective locations adjacent to the first cam portions 92. Each through hole 95 has an associated one of the power point portions 51*b* inserted therethrough.

When the actuator 9 is in the closed position, the second cam portion 93 pushes upward the power point portion 61*b* of the associated second contact 6, whereby the contact portion 61*a* of the associated second contact 6 is pushed downward such that the contact portion 61*a* enters the FPC-receiving space 34.

The actuator 9 has through holes 96 formed therethrough at respective locations adjacent to the second cam portions 93. Each through hole 96 has an associated one of the power point portions 61*b* extended therethrough.

The third cam portions 94 are formed at opposite ends of the actuator 9 in the longitudinal direction thereof. When the actuator 9 is in the closed position, each third cam portion 94 pushes upward an associated one of the locking power point portions 37*b* such that the nail portion 37*a* is inserted into a cutout formed in the FPC, not shown. The actuator 9 is formed with through holes 97 at respective locations adjacent to the third cam portions 94.

Edges of the through holes 95 and 96, toward the operating section 91, form pressing portions 98.

When the actuator 9 is in the open position (the state shown in FIGS. 2 and 3), the pressing portions 98 push downward the power point portions 51*b* and 61*b* inserted into the respective through holes 95 and 96, whereby the contact portions 51*a* and 61*a* of the respective first and second contacts 5 and 6 are lifted such that they are moved out of the FPC-receiving space 34.

Figure 13A:
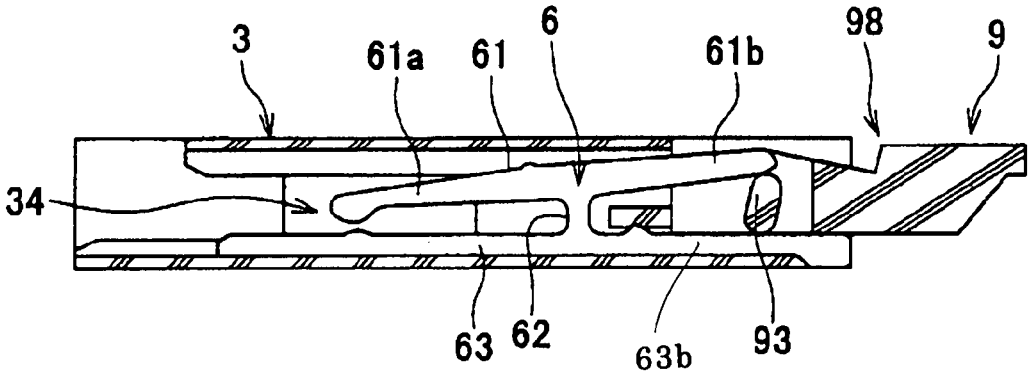
FIG. 13A is a cross-sectional view of the connector in a state in which the actuator is closed with no FPC inserted into the connector.
Figure 13B:
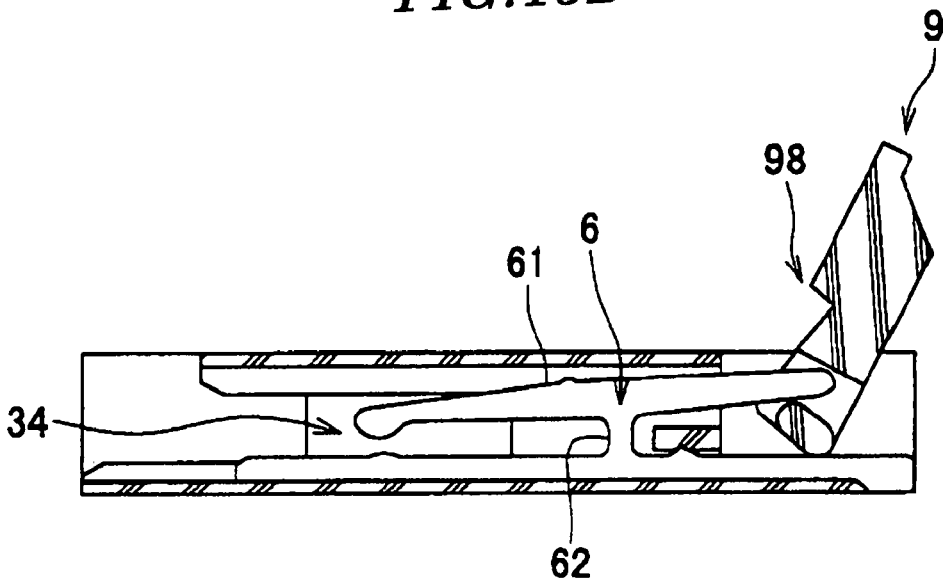
FIG. 13B is a cross-sectional view of the connector in a state in which the actuator is being moved from the FIG. 13A state to an open state.

Referring to FIG. 13A, when the actuator 9 is pivotally moved to the closed position without the FPC inserted into the connector, the first beam 61 of the second contact 6 is set such that it performs the seesaw operation through a larger pivot angle than that of the first beam 51 of the first contact 5, so that there is a fear that the spring piece 62 undergoes plastic deformation. Assuming that the spring piece 62 has been plastically deformed as shown in FIG. 13B, even if the actuator 9 is pivotally moved toward the open position, the first beam 61 remains in the FPC-receiving space 34. In the prior art, the FPC cannot be inserted when the connector is in this state.

Figure 13C:
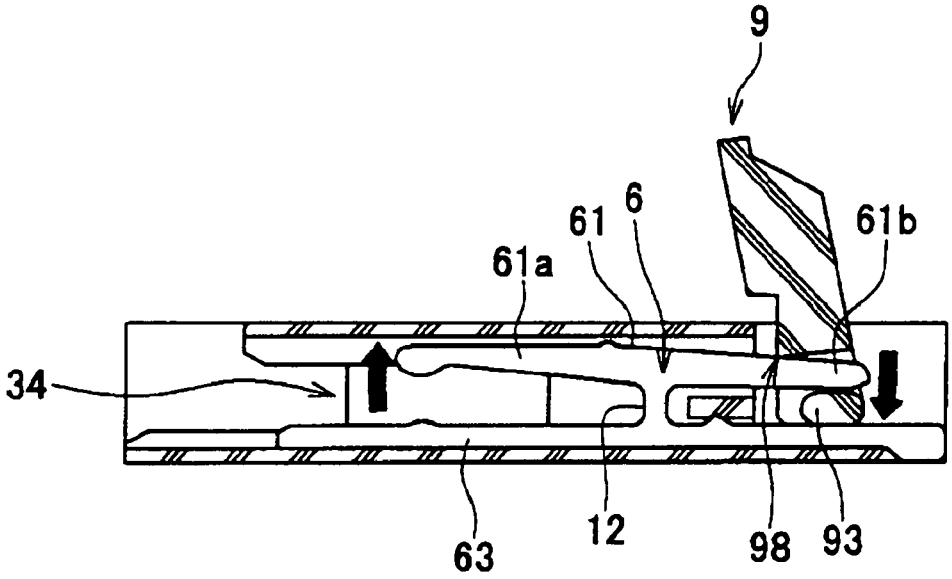
FIG. 13C is a cross-sectional view of the connector in a state in which contact portions of contacts are lifted by the actuator.
Figure 14:
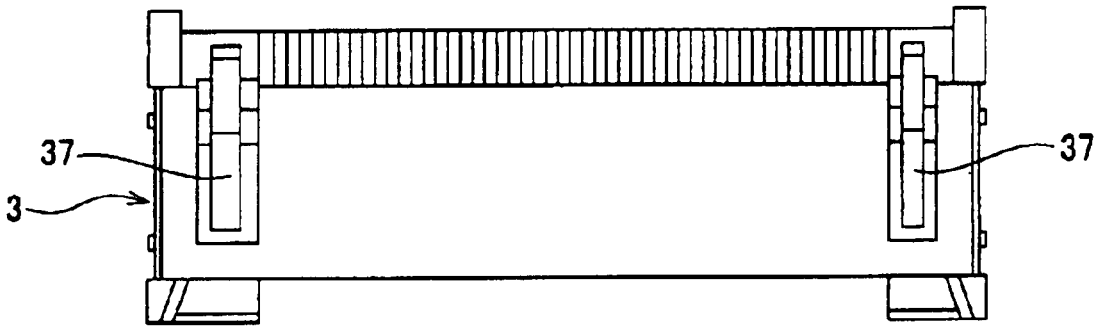
FIG. 14 is a plan view of a connector according to a second embodiment of the present invention.
Figure 15:
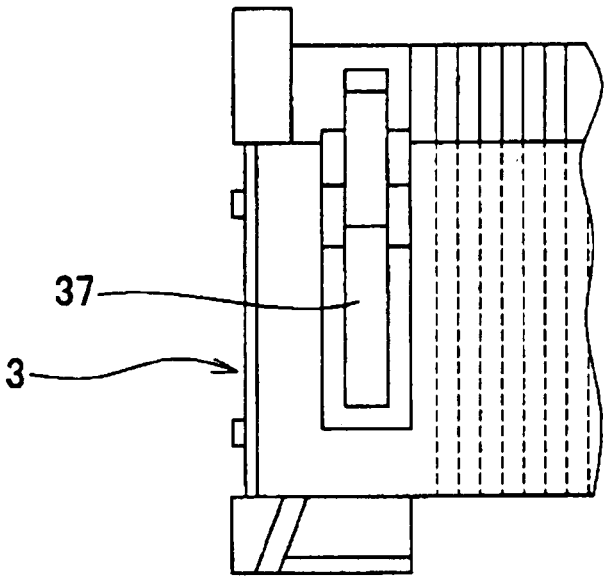
FIG. 15 is a plan view of one end of the FIG. 14 connector.

In the present embodiment, however, as shown in FIG. 13C, it is possible to urge the power point portions 61*b* by the pressing portions 98 of the actuator 9. This makes it possible to move the contact portions 61*a* away from the FPC-receiving space 34.

At this time, the power point portions 51*b* of the first contacts 5 are also pressed by the pressing portions 98, and therefore the contact portions 51*a* of the first contacts 5 are also moved away from the FPC-receiving space 34 simultaneously.

As described hereinabove, according to the present embodiment, it is possible to facilitate the insertion of the FPC and obtain a sufficient contact force.

Component parts identical to those of the connector according to the first embodiment are designated by identical reference numerals, and detailed description thereof is omitted, while only main component parts different in construction from those of the first embodiment will be described hereinafter.

Although in the first embodiment, operating section-side edges of the through holes 97 of the actuator 9 are configured such that they do not press the lances 37, in the second embodiment, pressing portions 298 of the actuator 209 for pressing the nail portions press the locking power point portions 37*b* of the lances 37. The pressing portions 298 perform the same operation as that pressing portions 98 of the actuator 9.

Figure 16A:
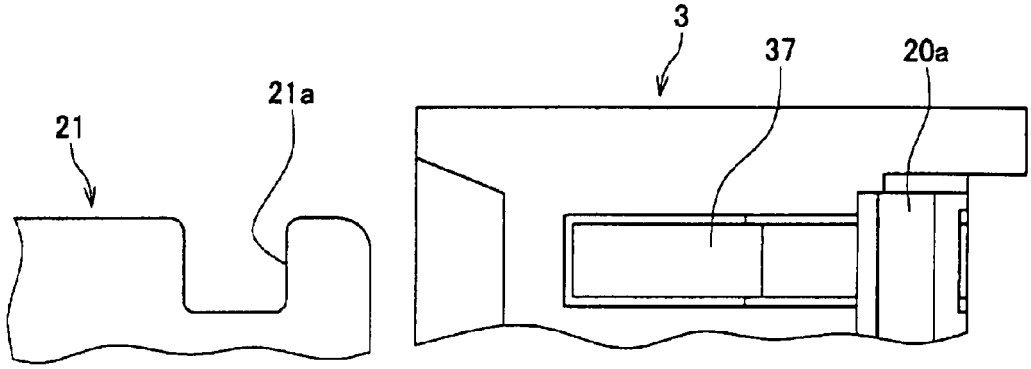
FIG. 16A is a plan view of the FIG. 14 connector in a state in which no FPC has been inserted therein yet.
Figure 16B:
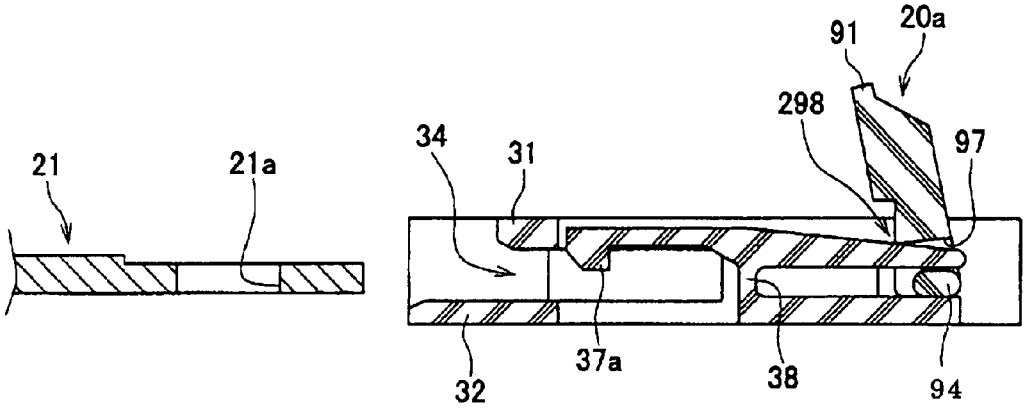
FIG. 16B is a cross-sectional view of the connector in the same state as shown in FIG. 16A.
Figure 17:
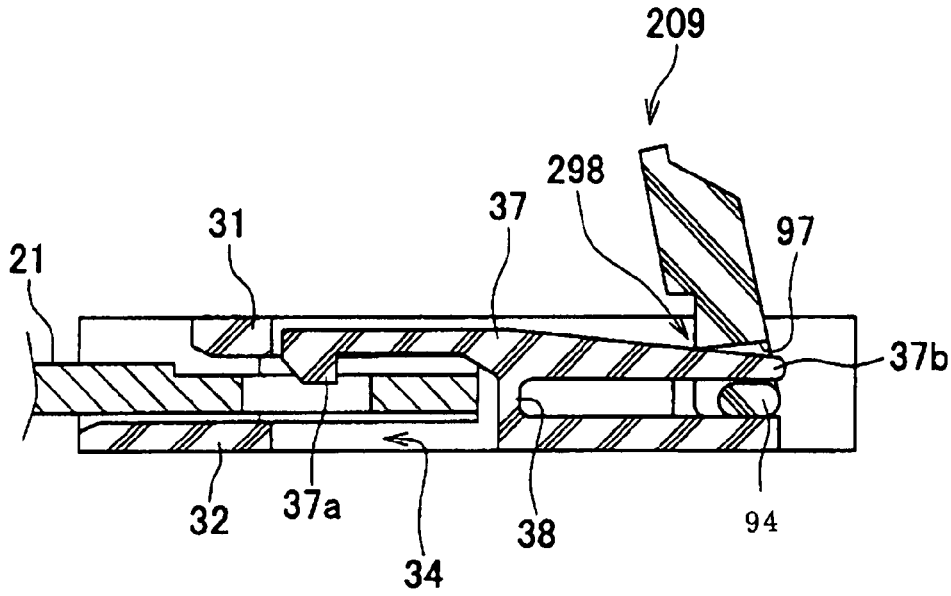
FIG. 17 is a cross-sectional view of the connector in a state in which an FPC is inserted therein, and an actuator is open.
Figure 18:
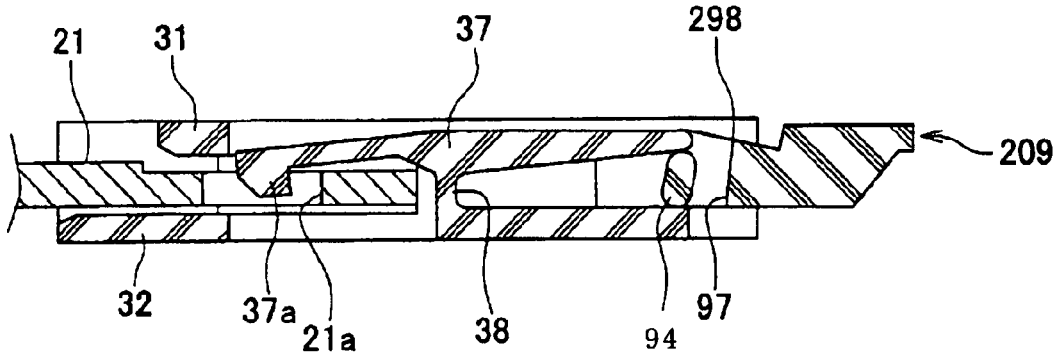
FIG. 18 is a cross-sectional view of the connector in a state in which the actuator is closed.

Referring to FIGS. 16A and 16B, the nail portion 37*a* of each lance 37 is configured to be slightly inserted into the FPC-receiving space 34 when the actuator 209 is in the open position. This causes the FPC 21 to be brought into slight contact with the nail portion 37*a*, when the FPC 21 is inserted into the FPC-receiving space 34, as shown in FIG. 17.

With this construction, the insertion of the FPC 21 is hardly hindered by the nail portion 37*a*, and further it is possible to prevent the FPC 21 from being displaced when the actuator 209 is pivotally moved from the open position to the closed position. If the actuator 209 is pushed until it reaches the closed position, the nail portion 37*a* can be positively inserted into a cutout 21*a* formed in the FPC 21, thereby making it possible to positively lock the FPC 21.

According to the present embodiment, it is possible to obtain the same advantageous effects as provided by the first embodiment, to prevent the FPC 21 from being easily removed from the connector.

It should be note that although in the above-described embodiments, the present invention is applied to the connector for an FPC, this is not limitative, but the present invention can also be applied to a connector e.g. for an FFC (Flexible Flat Cable).

It is further understood by those skilled in the art that the foregoing are the preferred embodiments of the present invention, and that various changes and modification may be made thereto without departing from the spirit and scope thereof.

What is claimed is:

1. A connector comprising:

a housing that has a receiving space into which a connected object is inserted;

a plurality of contacts that are held by said housing, and each include a seesaw-type beam having one end thereof formed with a contact portion for contact with the connected object, and the other end thereof formed with a power point portion; and an actuator mounted in said housing such that said actuator is pivotally movable between an open position for allowing insertion of the connected object into the receiving space and a closed position for holding the connected object in the receiving space, said actuator including pressing portions for enabling a turning force of said actuator to act on the power point portions when the actuator is in the open position, to push downward the power point portions to thereby move the contact portions out of the receiving space, and cam portions for enabling the turning force of said actuator to act on the power point portions when the actuator is in the closed position, to push upward the power point portions to thereby move the contact portions into the receiving space.

2. A connector as claimed in claim 1, wherein said housing includes seesaw-type locking sections each having one end thereof formed with a nail portion for engagement with the connected object, and the other end thereof formed with a locking power point portion on which the turning force of said actuator acts, and wherein said actuator includes pressing portions for the nail portions, for pushing downward the locking power point portions when the actuator is in the open position, to thereby move the nail portions away from the connected object, and cam portions for the nail portions, for pushing upward the locking power point portions when the actuator is in the closed position, to thereby move the nail portions toward the connected object.

* * * * *